US008328540B2

(12) United States Patent
Wang

(10) Patent No.: US 8,328,540 B2
(45) Date of Patent: Dec. 11, 2012

(54) STRUCTURAL IMPROVEMENT OF SUBMERSIBLE COOLING PUMP

(76) Inventor: Li-Chuan Wang, Taichung County (TW)

( * ) Notice: Subject to any disclaimer, the term of this patent is extended or adjusted under 35 U.S.C. 154(b) by 343 days.

(21) Appl. No.: 12/717,354

(22) Filed: Mar. 4, 2010

(65) Prior Publication Data

US 2011/0217193 A1 Sep. 8, 2011

(51) Int. Cl.
*F04B 35/04* (2006.01)

(52) U.S. Cl. ..... 417/423.3

(58) Field of Classification Search ..... 417/423.3, 417/423.7, 423.14, 410.1
See application file for complete search history.

(56) References Cited

U.S. PATENT DOCUMENTS

| | | | | |
|---|---|---|---|---|
| 4,934,914 | A * | 6/1990 | Kobayashi et al. | 417/423.3 |
| 5,076,762 | A * | 12/1991 | Lykes et al. | 417/40 |
| 6,345,964 | B1 * | 2/2002 | Cooper | 417/423.3 |
| 6,474,952 | B1 * | 11/2002 | Fisher et al. | 417/40 |
| 7,165,953 | B2 * | 1/2007 | Reynders et al. | 417/424.1 |
| 2005/0019184 | A1 * | 1/2005 | Geisinger et al. | 417/423.3 |
| 2005/0214143 | A1 * | 9/2005 | Stirling et al. | 417/423.9 |
| 2007/0025866 | A1 * | 2/2007 | Douyama et al. | 417/423.3 |
| 2007/0166178 | A1 * | 7/2007 | Moreland | 417/423.3 |
| 2008/0279704 | A1 * | 11/2008 | Cooper | 417/423.1 |

* cited by examiner

*Primary Examiner* — Charles Freay
*Assistant Examiner* — Alexander Comley
(74) *Attorney, Agent, or Firm* — Rosenberg, Klein & Lee

(57) ABSTRACT

A structural improvement of submersible cooling pumps, especially a submersible cooling pump that is capable of enhancing the stability and extending service life, comprising a motor set, an impeller set and a stud set, characterized in that in said motor set, there are provided on the motor casing a top plate, disposed on which is a fan with orifices, and a motor cover having sight holes and cross-shaped ventilating holes that spreads all over the cover, disposed on top of said fan, and a protection cover with a small elastic plate provided to cloak said motor cover which is screw fastened to said motor casing; the lower end of said motor casing fits on the upper rim of the trough of a fixing base, and is fastened onto the fixing hole base of said fixing base; on said fixing base an outlet port and shaft hole are provided, and by both sides of said shaft hole an ingress of water and a positioning hole that permits the screw fastening of another element are provided; said impeller set combines and fastening an upper cover and a lower cover to accommodate a set of vanes, wherein an outlet hole is provided by one side, and a fixing hole by the other side, of an inlet hole of said upper cover; and said stud set consists of a duct pipe and a support pipe, both of equal length, of which the support pipe has female thread at each end allowing it to be screw fastened to the positioning hole of said motor set and the fixing hole of said impeller set, respectively.

4 Claims, 9 Drawing Sheets

STRUCTURAL IMPROVEMENT OF SUBMERSIBLE COOLING PUMP

BACKGROUND OF THE INVENTION

1. Field of the Invention

The present invention relates to a structural improvement of submersible cooling pump, more specifically, a submersible cooling pump that varies in the length of its stud set as required, has better structural stability and longer service life, as well as allows the spinning direction of motor, indicated by the rotation of provided orifices, to be observed directly through sight holes on the motor cover.

2. Description of the Prior Art

Submersible cooling pumps structurally consist mainly of a motor set and an impeller set, wherein the impeller set is immersed in a liquid container, and a supporting stud set is provided connecting the motor set with said impeller set; when the motor set operates, its shaft drives the impeller set, whose vanes turn and introduce the liquid from outside into the impeller set through the port in an upper cover and discharge, by centrifugal force, the liquid out, through a duct pipe, to an inlet port in the motor set to be finally discharged, through a passage, out from an outlet port. Such a submersible cooling pump has drawbacks as follows:

1. Its stud set together with the impeller set being in a fixed pattern is unable to change the length to adapt to different depths of the liquid container. It thus necessitates a multiple of submersible cooling pumps of varied sizes ready to meet different demands, increasing the space and costs needed by inventory for vendors.
2. On the blades of the motor set, an "indicator point" in a color (usually white) other than that of the blades is provided for observation on the blades' rotating direction when the motor operates abnormally, to allow the determination of whether the motor rotates in normal or reverse direction. So, to make such an observation requires removing the motor cover, an inconvenient and dangerous operation; besides, to determine the direction of the rotation, it must take a while of observation, somewhat tedious practice, as the indicator point is too small to make an easy determination.
3. Also, in motor casing, the motor cover is provided with heat dissipating holes allowing the heat generated by the motor in its rotation to be dissipated through; but, in previous motor casings, there is no protective structure to prevent dust or chips from entering the pump which cause damages to the parts of the device.

SUMMARY OF THE INVENTION

The primary object of the present invention is to provide a submersible cooling pump that varies in the length of its stud set as required and has better coaxial fastening stability during the actuation of the pump and a relatively longer service life by means of providing a removable support pipe that is disposed on the one side other than where the duct pipe is.

Another object of the present invention is to provide a submersible cooling pump with a motor set that is provided with, on the motor casing, a screw fastened motor cover, and, under the same casing, a fixing base fastened also by screws, so as to make inspection and servicing of the motor easy.

Yet another object of the present invention is to provide a submersible cooling pump with a fan, on which an opposite pair of orifices are provided, and with a motor cover, on which arrow-shaped sight holes are provided, whereby it is possible to observe directly through the sight holes the direction of rotation of the orifices, indicating the motor's spinning direction, as well as to make silent spinning by the orifices.

Further another object of the present invention is to provide a submersible cooling pump with a motor set with a motor cover on which a protecting cover is provided to serve as a dust cover effectively keeping foreign objects like chips from entering the components of the device.

DESCRIPTION OF THE PREFERRED EMBODIMENT

References will be made to the drawings in conjunction with the below stated preferred embodiments to provide better understanding of the contents of the present invention.

Figure 1:
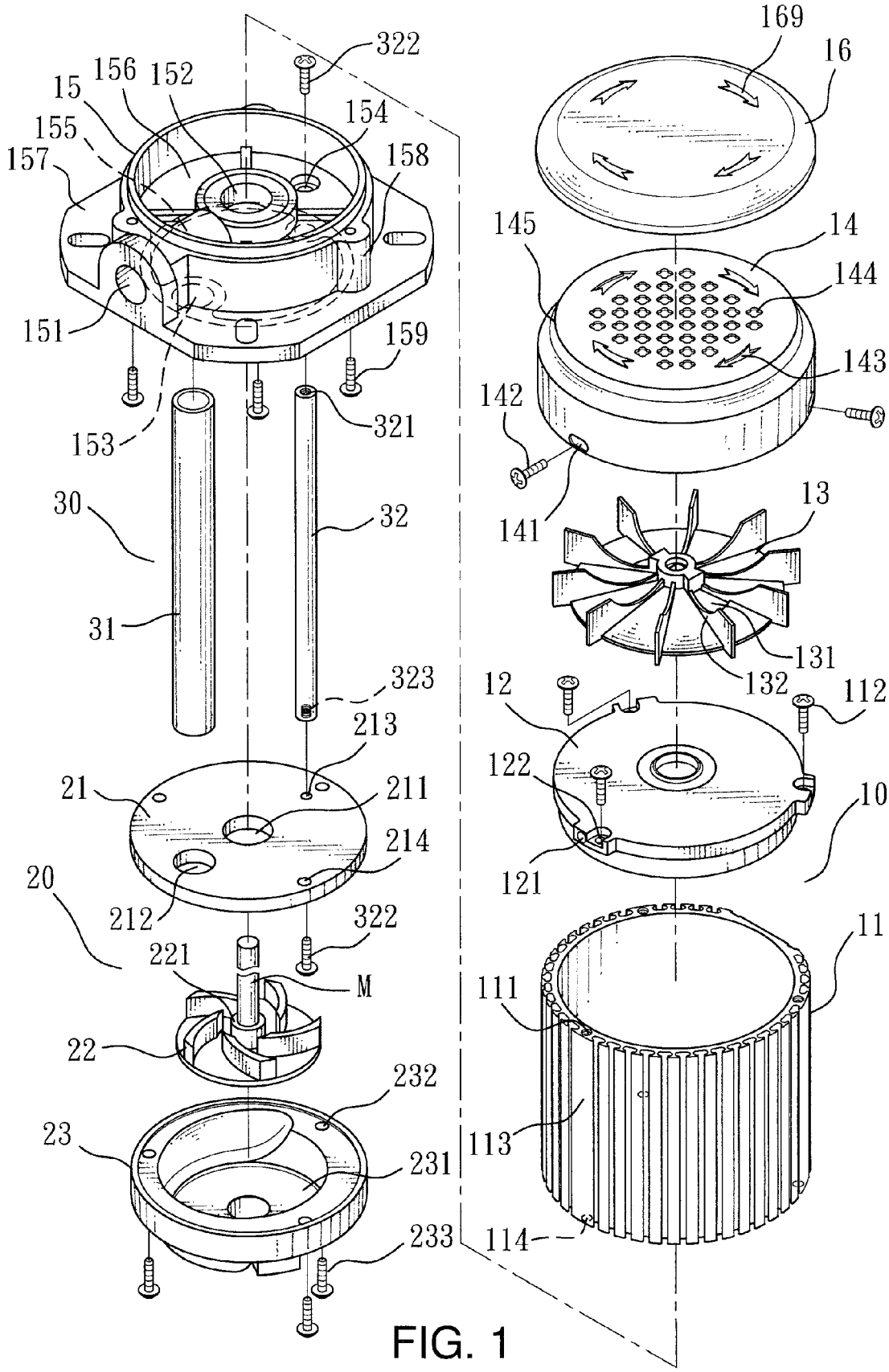
FIG. 1 is an exploded perspective view of the first embodiment of the present invention.
Figure 2:
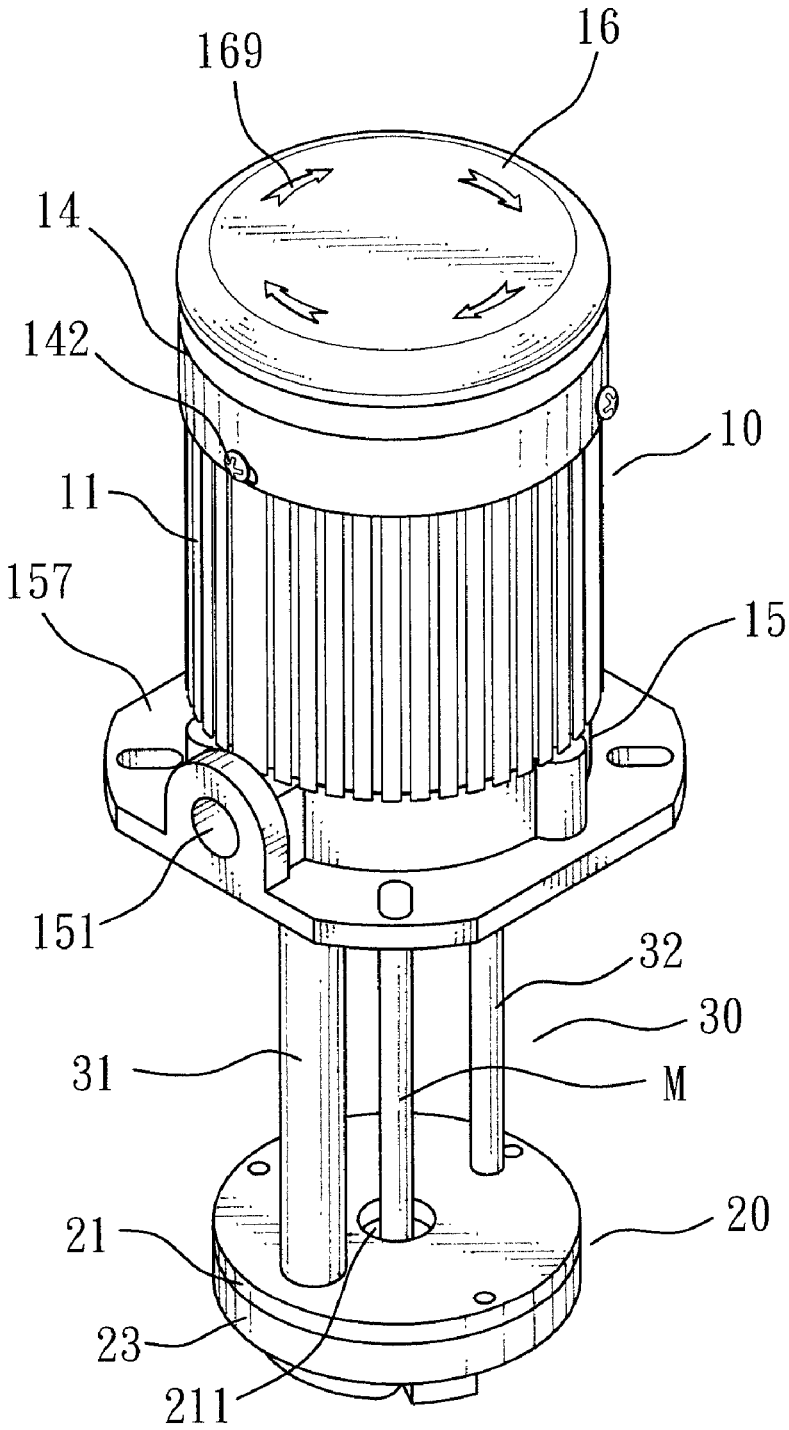
FIG. 2 is a perspective view of the first embodiment of the present invention.
Figure 3:
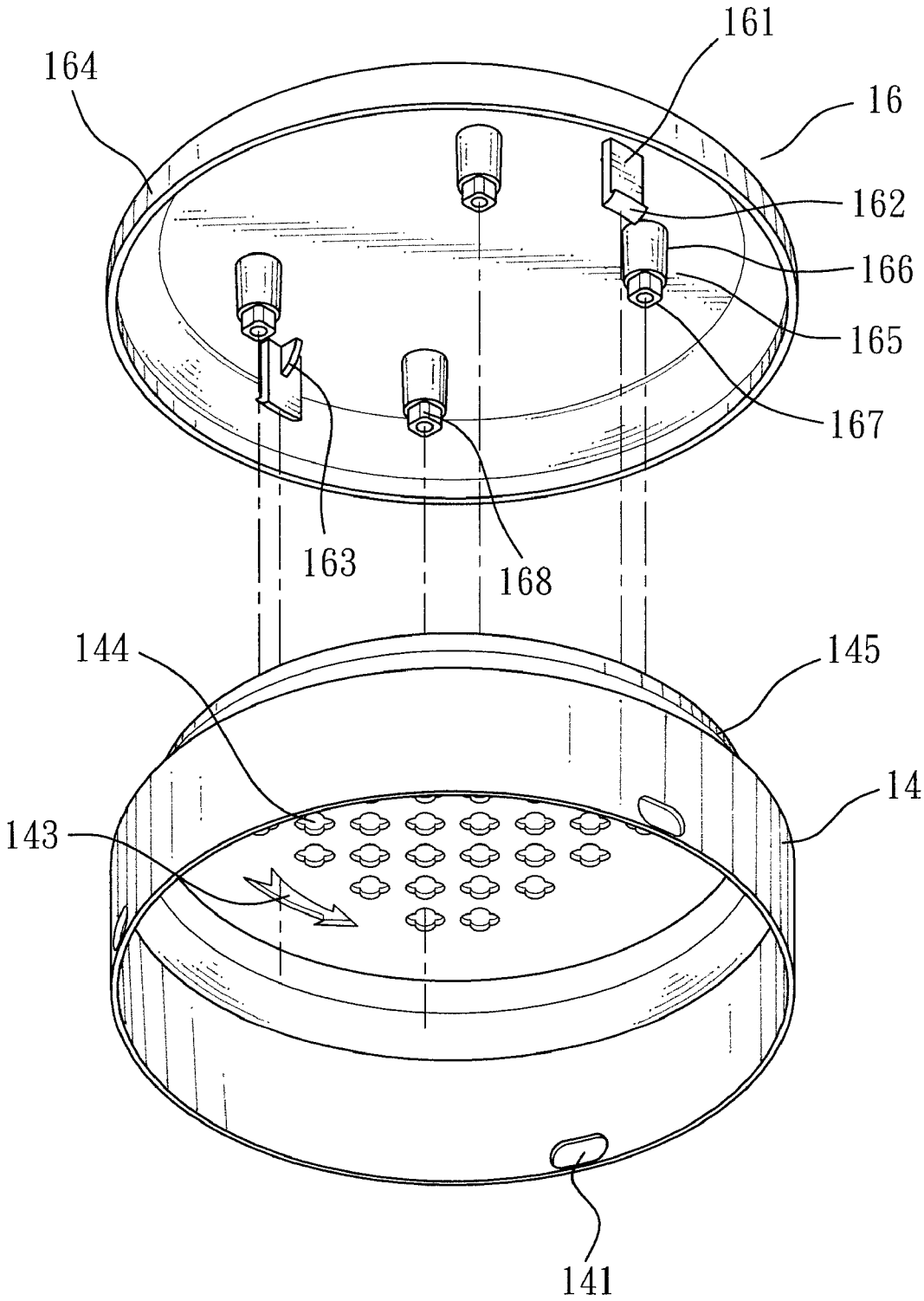
FIG. 3 shows the protecting cover and the motor cover of the present invention.
Figure 4:
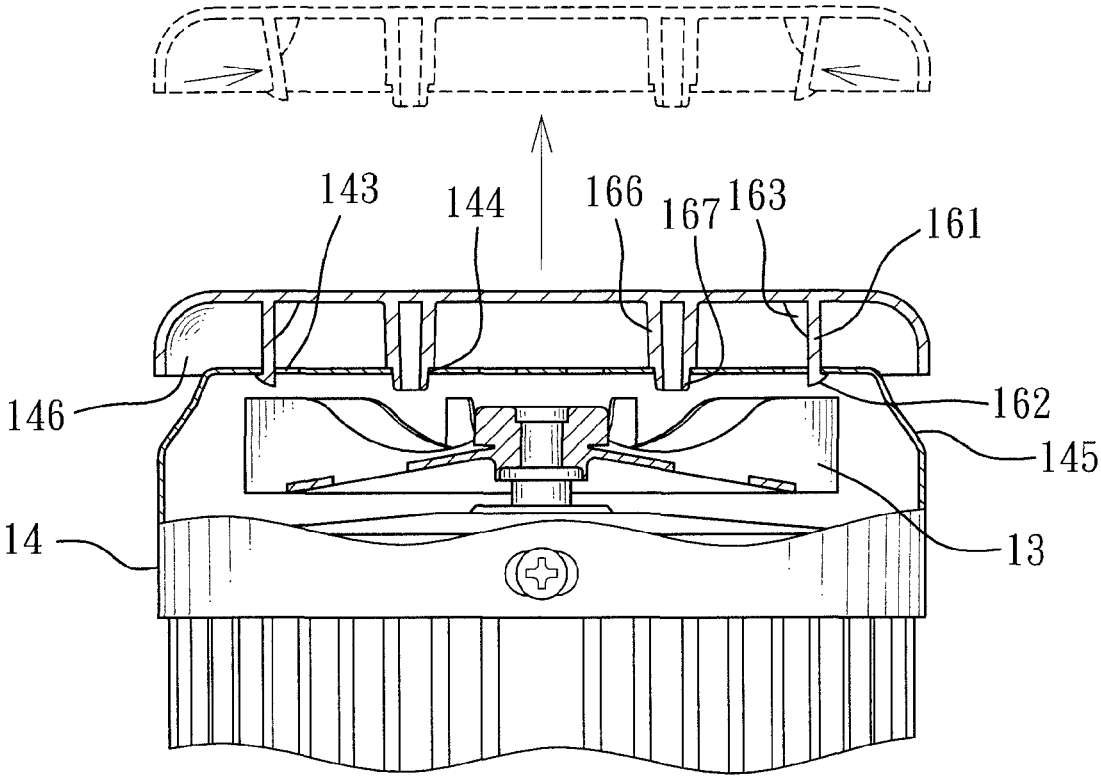
FIG. 4 is a cut-away view of the first embodiment of the present invention in assembly (1).
Figure 5:
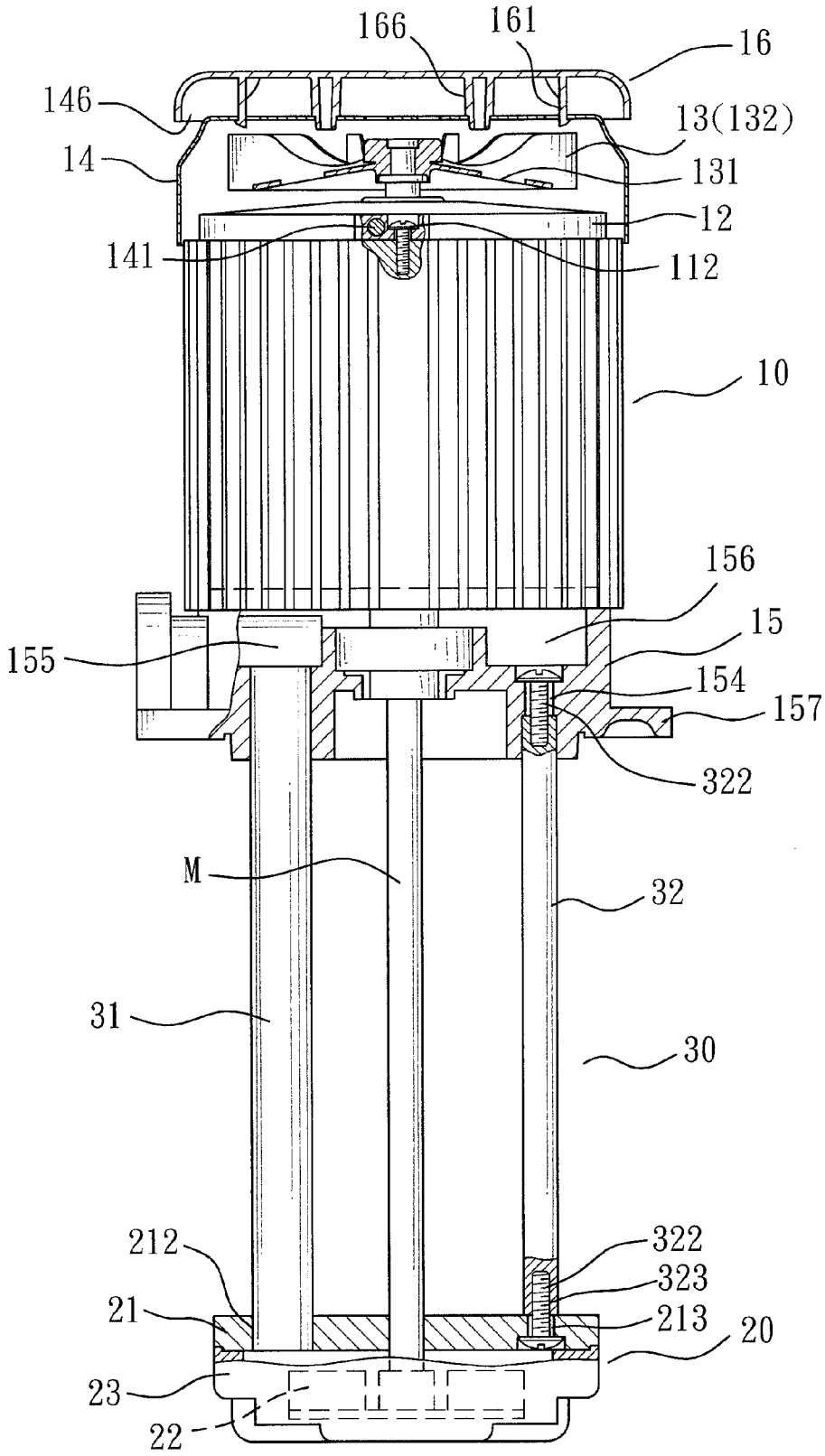
FIG. 5 is a cut-away view of the first embodiment of the present invention in assembly (2).

Reference is first made to FIG. 1 to FIG. 5, which show a first embodiment of the present invention that comprises a motors set 10, an impeller set 20 and a stud set 30; wherein said motors set 10 has a motor casing 11, which has two or more flat areas 113 and a plurality of grooves, and a plurality of screw holes 111 on the upper rim to allow the attachment of the fixing holes of a top plate 12 thereto through screws 112; a fan 13 and a motor cover 14 provided on said top plate 12, said fan 13, on which an opposite pair of orifices 131 is provided, consisting of a plurality of arc-shape guide blades 132, said motor cover 14 having through holes 141 on the side for its attachment to said top plate 12 along with screws holes 121 on the top plate 12 by screws 142, the same motor cover 14, the upper side of whose rim forms a recessed guiding surface 145, also having arrow shaped sight holes 143 and cross-shaped ventilating holes 144 densely distributed inside the imaginary circle of the sight holes 143; and a fixing base 15, with trough 156, on the upper rim of which said motor casing 11 fits, said motor casing 11 having a plurality of screw holes 114 to facilitate its attachment to the fixing hole bases 158 of said fixing base 15 by screws 159, the bottom of said trough 156 being above the level of the positioning flanges 157 provided on both sides of said fixing base 15, the fixing base 15 having an outlet port 151 on one side and an axial hole 152 in the center, on both sides of which an ingress of water 153 and a positioning hole 154 that permits fastening of another component by screw are provided, a passage 155 provided between and to connect both said ingress for water 153 and said outlet port 151; a protecting cover 16 provided on said motor cover 14, the inner side of the rim of said protecting cover 16 being provided with flexible clips 161 whose positions correspond to those of the sight holes 143 on said motor cover 14, said flexible clips 161 having an end extending to form a flexible hook 162 to engage with the inner edge of the sight holes 143 on said motor cover 14, also a flexible rib 163 being provided between said flexible clips 161 and said protecting cover 16; the rim 164 of said protecting cover 16 having a height equal to those of said flexible clips 161; matching poles 165 being provided on the inner side of said protecting cover 16, said matching poles 165, whose positions correspond to those of the ventilating holes 144 on said motor cover 14, having an upper section 166 in cylinder shape and a lower section 167 in the shape of a square column, on which lower section 167 a positioning surface 168 is formed between two faces (as shown in FIG. 3); said protecting cover 16 being provided on top side with markings of arrow 169 whose positions correspond to those of the sight holes 143 on said motor cover 14;

Said impeller set 20 consists of a top cover 21, a set of vanes 22 and a bottom cover 23; of which the top cover 21 has an inlet hole 211 for the motor shaft M to extend through, an outlet hole 212 and a fixing hole 213, each on one side of the inlet hole 211, and a plurality of screw holes 214, amid said set of vanes 22 a bearing base 221 is provided to orientate the motor shat M and allow it to drive the vanes 22, and said bottom cover 23 has a chamber 231 to accommodate said vanes 22, and threaded holes 232 corresponding to said top cover 21 such that it can combine with the top cover 21 by screws 233 in the same number as these threaded holes 232;

Said stud set 30 consists of a duct pipe 31 and a support pipe 32, both of the same length; wherein the upper end of said duct pipe 31 fits in the ingress of water 153 of the motor set 10, and the lower end of the same pipe 31 fits in the outlet hole 212, and provided on each of the two ends of said support pipe 32 are an upper female thread 321 and a lower female thread 323, through which the support pipe 32 is securely set in the positioning hole 154 of the motor set 10 and the fixing hole 213 of the impeller set 20 by screws 322.

By such structure, when the motor of the motor set 10 operates, its shaft M drives the vanes 22 of the impeller set 20 to channel the exterior liquid through the inlet hole 211 of the top cover 21 into the impeller set 20 and out of it through the outlet hole 212, then force the liquid passing the duct pipe 31 into the ingress of water 153 of the motor set 10 and through the passage 155 to be discharged from the outlet port 151. With such embodiment of the present invention, it is possible to change the length of said duct pipe according to the requirement as well as to enhance the coaxial fastening linkage between the motor set 10 and the impeller set 20 by the support pipe 32 to increase the structural stability and eliminate any possible gap between the duct pipe 31 and the outlet hole 212, thus facilitate effective liquid transportation; moreover, there are provided on the motor set 10 detachable motor cover 14 and fixing base 15, which make servicing convenient; and further, in the same motor set 10, the bottom level of the trough 156 of said fixing base 15 is above that of the positioning flange 157 so as to prevent the liquid from entering the trough 156, effectively eliminating the trouble of the motor being soaked.

Also, said protecting cover 16 of the motor set 10 being of elastic material, to assemble, it only takes pressing on both sides of the cover rim 164 to deform the flexible clips 161 such that their end sections along with the flexible hook 162 bend backward to allow the insertion of the flexible hook 162 into said sight holes 143 on said motor cover 14; then, with hands leaving said cover rim 164, it restores the original condition such that the flexible hooks 162 are fastened to the inside edge of the sight holes 143 on said motor cover 14 to achieve the in-place assembly. At this point, the rim 164 of said protecting cover 16 and the recessed guiding surface 145 of said motor cover 14 form a heat dissipating zone 146, while the square column shaped lower section 167 of said matching poles 165 fits in said ventilating hole 144 to give a position limiting effect. When the fan 13 rotates, the heat is dissipated through the ventilating holes 144 and the sight holes 143 on said motor cover 14, and said heat dissipating zone 146, whereas by the blocking of the rim 164 of said protecting cover 16, chips are effectively kept from entering the device. On the other hand, when there is a need to disassemble for examination, it only takes pressing on both sides of the cover rim 164 to deform the flexible clips 161 such that their end sections along with the flexible hook 162 bend backward, which flexible hooks 162 disengage with said sight holes 143 on said motor cover 14 as the protecting cover 16 is lifted, with said matching poles 165 drawn out of said ventilating hole 144.

In addition, in the present invention, an opposite pair of orifices is provided on the fan 13, while sight holes 143 are provided on the motor cover 14; whereby when the motor operates abnormally, observation on the rotating direction of these orifices 131 directly from the sight holes 143 on the motor cover 14 is allowed, to determine the rotating direction of the motor. This solves the shortcoming, in prior arts, of having to remove the motor cover 14 to observe.

Further in the present invention, as provided on the top side of said protecting cover 16 are markings of arrow 169 whose positions correspond to those of the sight holes 143 on said motor cover 14, it is possible to tell the direction in which the motor rotates; alternatively, said protecting cover 16 can be made a clear piece to allow direct observation of the rotating direction of the motor.

Meanwhile, in the present invention, said ventilating holes 144 in the shape of a cross are able to fit the square column-shaped lower section 167 of said matching poles 165, while the positioning surfaces 168 of said lower section 167 can be used to increase the friction with said ventilating holes 144 to give a positioning and anti-sliding effect.

Figure 6:
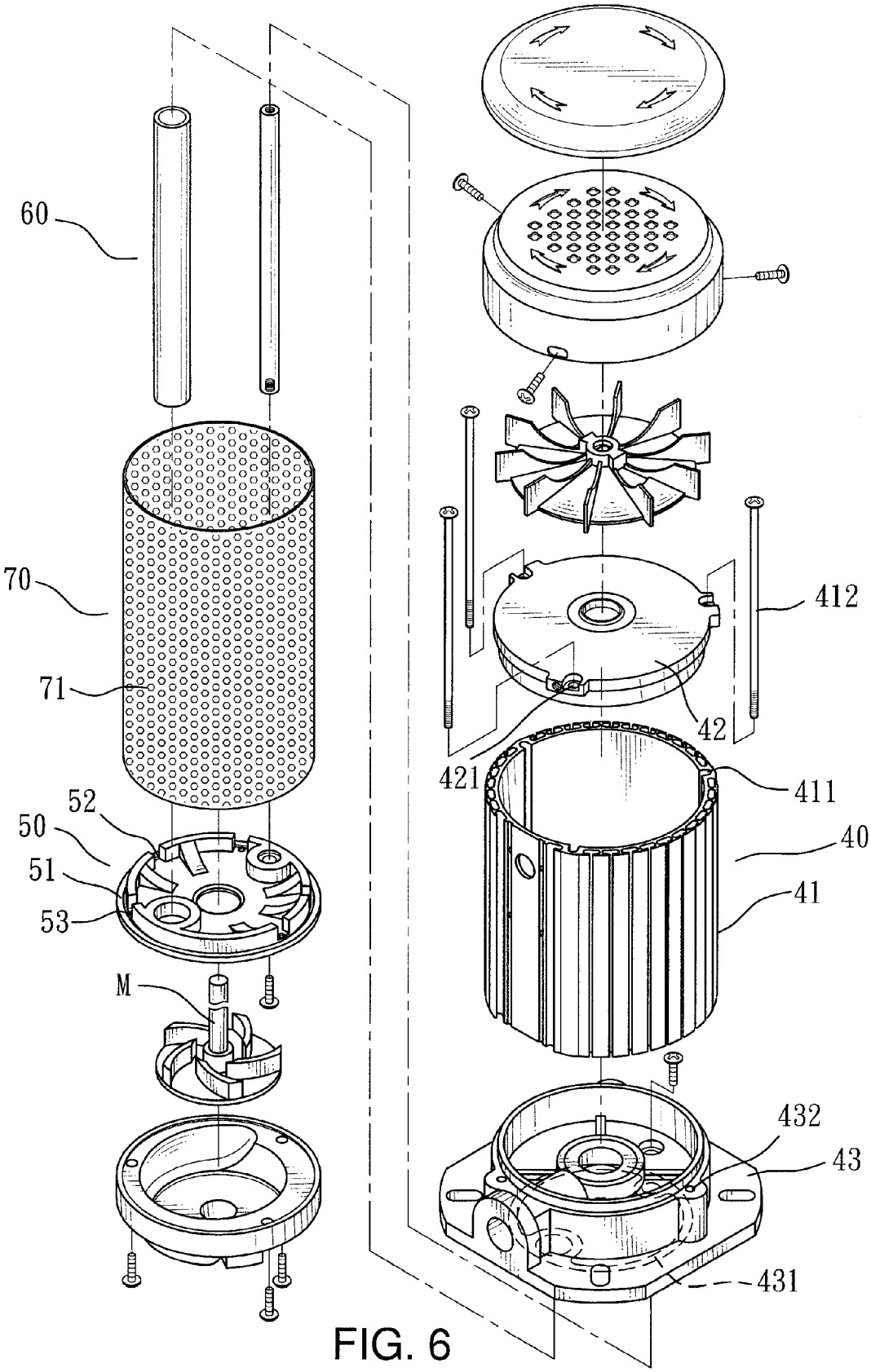
FIG. 6 is an exploded perspective view of the second embodiment of the present invention.
Figure 7:
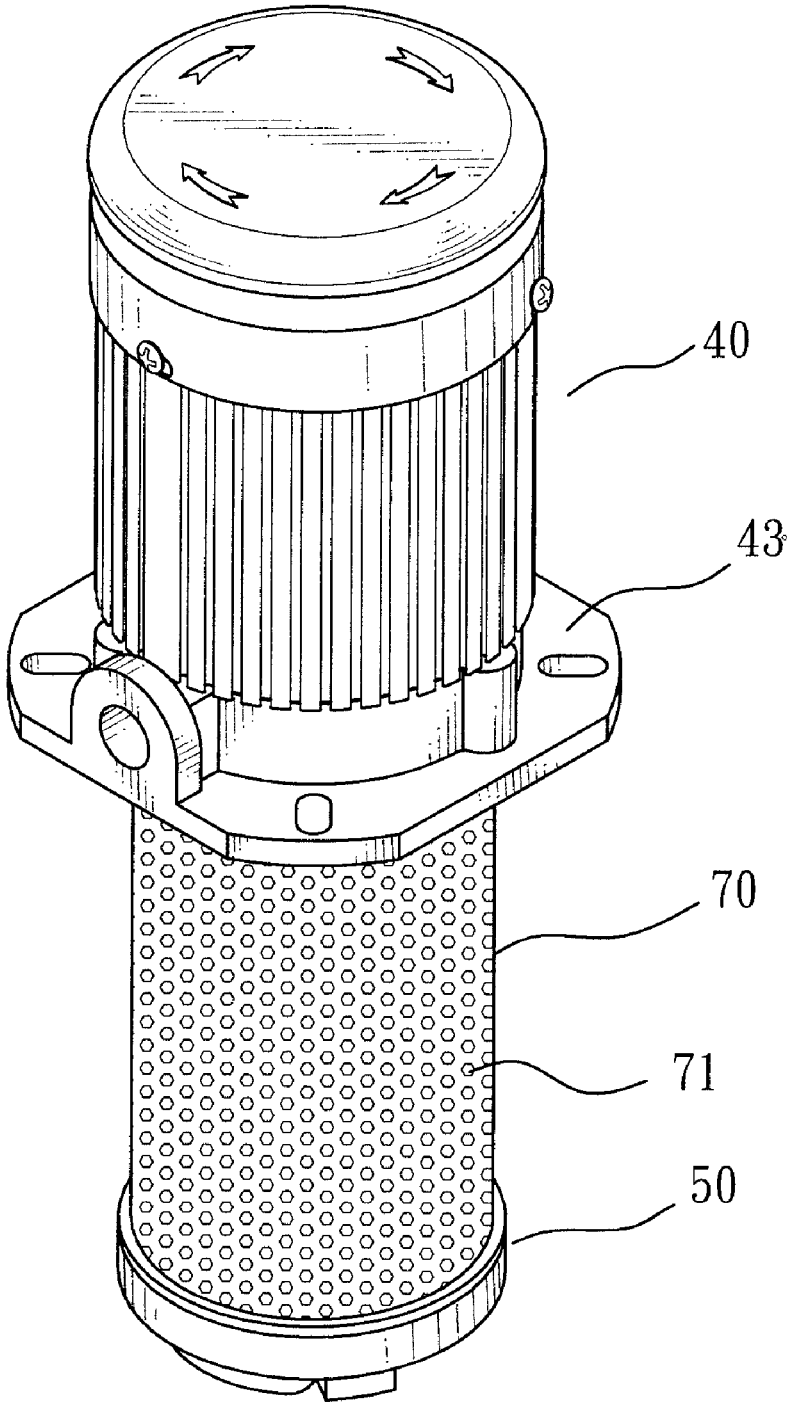
FIG. 7 is a perspective view of the second embodiment of the present invention in assembly.
Figure 8:
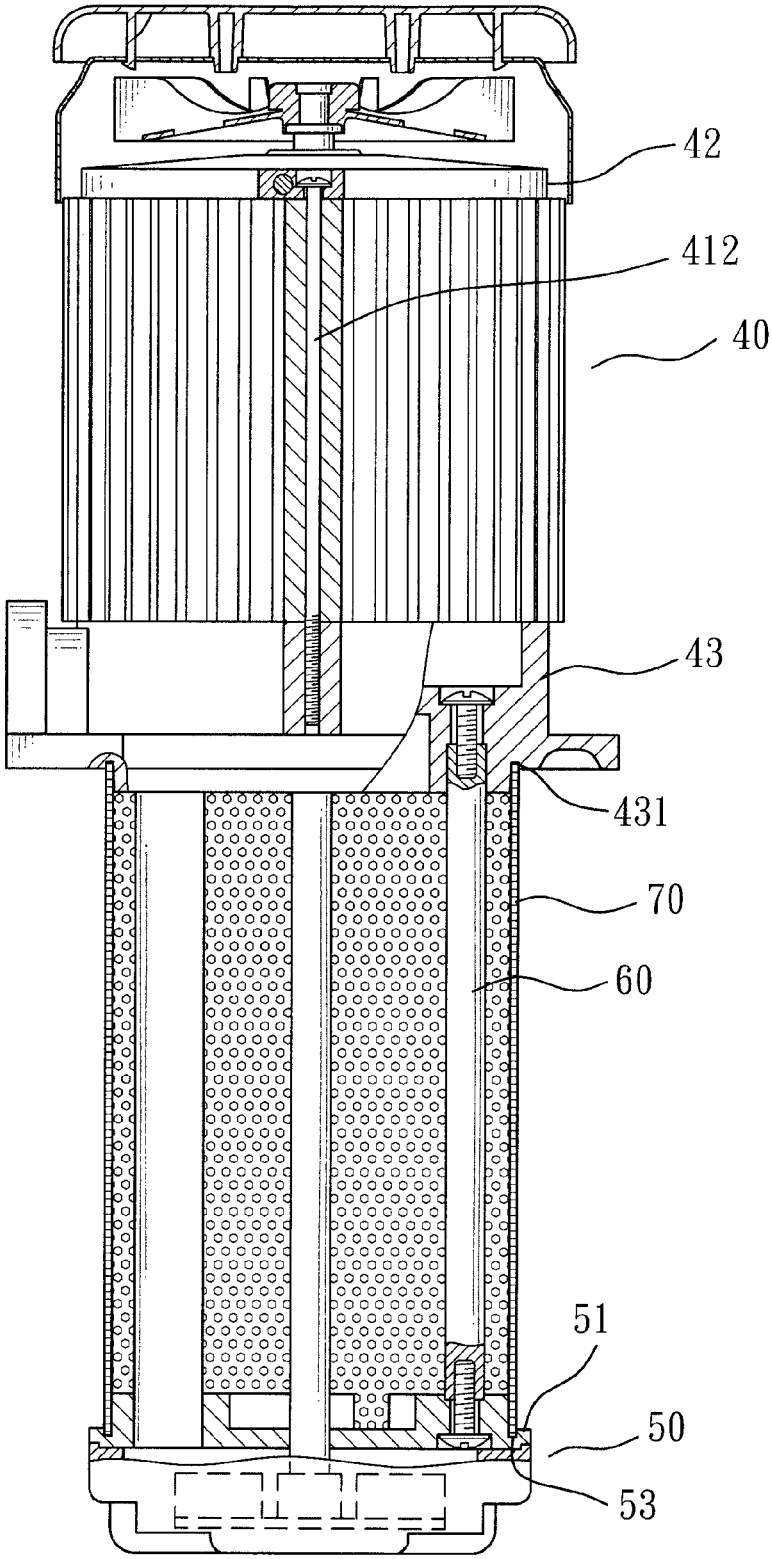
FIG. 8 is a cut-away view of the second embodiment of the present invention in assembly.
Figure 9:
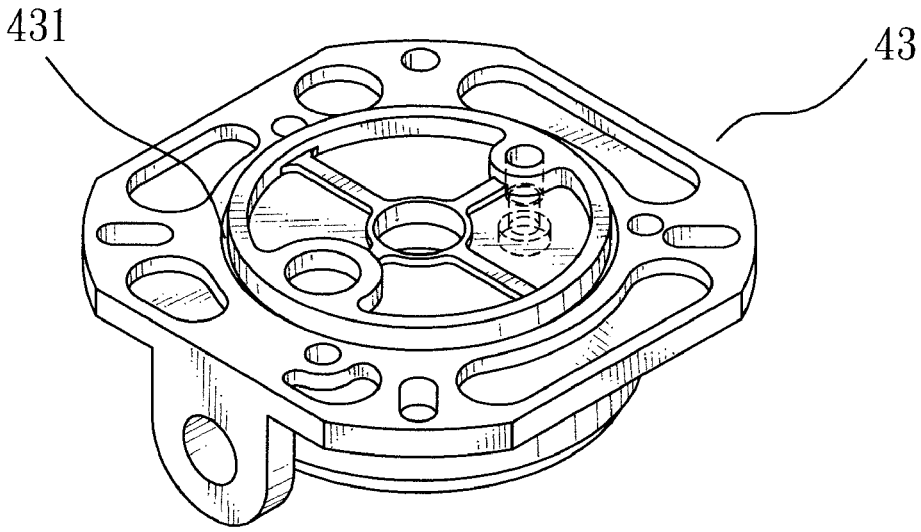
FIG. 9 is a bottom perspective view of the fixing base of the second embodiment of the present invention.

Reference is now made to FIG. 6 to FIG. 8, which show an additional filter drum 70 provided in between the impeller set 50 and the motor set 40 of the present invention for the purpose of providing filtration; wherein, as said motor set 40, impeller set 50 and stud set 60 are largely in the same structure as the foregoing embodiment, they take no repeated description; explication in detail will be given only to some differences:

of said motor set 40, the inside of the motor casing 41 is provided, with two or more positioning slots 411 which go all the way through the bottom thereof (to replace above-mentioned screw holes 111, 114), and through which the fixing bolts 412 having been inserted through the fixing holes 421 in the edge of the top plate 42 can go and be screw fastened to the threaded fixing hole column 432 of the fixing base 43; on the bottom of said fixing base 43, an upper annular groove 431 is provided (as seen in FIG. 9) to allow the top section of the filter drum 70 to fit in;

of said impeller set 50, provided on the top surface of the top cover 51 are a plurality of inlet passages 52, around which the peripheral forms a lower annular groove 53 to allow the filter drum to fit in;

said filter drum 70 is a single-piece component densely provided with liter holes 71 thereon;

with such structure, said filter drum 70 not only effects the filtration on the incoming liquid, but also increases the structural strength of the submersible cooling pump.

Figure 10:
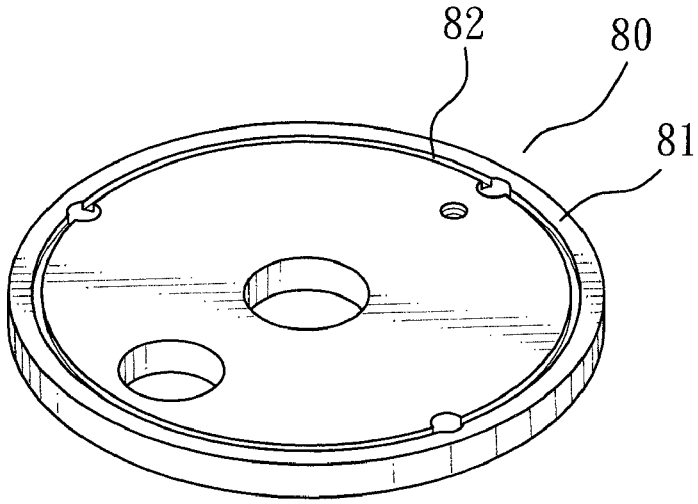
FIG. 10 is a schematic view of the top cover of the third embodiment of the present invention.

Reference is now made to FIG. 10, which shows a third embodiment of the present invention. This embodiment has the same function as that of the foregoing filter drum, yet, it further provides a lower annular groove 82 in the top surface of the top cover 81 in order for the filter drum to fit in and achieve the same effect.

All the foregoing description is given to make it clear that with the capability of changing the length of the pipes, and of enhancing the linkage between the motor set and the impeller set so as to prolong the service life, the convenience in inspecting and servicing the motor, as well as a protecting cover keeping dust and chips from entering the components of the device, the present invention possesses non-obviousness as well as utility.

I claim:

1. A structural improvement of submersible cooling pumps, comprising a motor set, an impeller set and a stud set, wherein said motor set has a motor casing, which has two or more screw holes on an upper rim thereof to allow fastening of the motor casing to a top plate by screws; a fan and a motor cover disposed on said top plate, said motor cover having arrow-shaped sight holes and cross-shaped ventilating holes densely distributed in an area encompassed by the sight holes, said motor cover having through holes on a side for attachment to said top plate along with screw holes on the top plate by screws; and a fixing base, a bottom of said motor casing fitting on an upper rim of a trough thereof and screw fastened to fixing hole bases thereof, and both sides thereof extending to form positioning flanges; on said fixing base, an outlet port is provided on one side and an axial hole is in a center for a shaft to extend through, on both sides of the axial hole is an ingress of water and a fixing hole, which allows screw fastening of another component, and a passage in communication with said ingress of water and said outlet port are provided; a protecting cover is provided on top of said motor cover, said protecting cover having, on an inner side, flexible clips whose positions correspond to positions of the sight holes on said motor cover, said flexible clips having an end extending to form a flexible hook to engage with an inner edge of the sight holes on said motor cover, which has a rim with a height equal to that of said flexible clips, and, also on its inner side, matching poles whose positions correspond to positions of the ventilating holes on said motor cover; said impeller set consists of a top cover, a set of vanes and a bottom cover, of which the top cover has an inlet hole for the motor shaft to extend through, an outlet hole and a fixing hole each on one different side of said inlet hole, and a plurality of threaded holes; amid said set of vanes a bearing base is provided to accommodate the motor shaft and allow it to drive the vanes; said bottom cover has a chamber to accommodate said set of vanes, and threaded holes corresponding to said top cover such that the bottom cover can securely combine with the top cover by screws in an equal number of the threaded holes; said stud set consists of a duct pipe and a support pipe, both of the same length; wherein a top end of said duct pipe fits in the ingress of water of the motor set, and a bottom end of the same pipe fits in the outlet hole of the impeller set; female threads are provided on both ends of said support pipe, through which the support pipe is securely set in place in the positioning hole of the motor set and the fixing hole of the impeller set by screws.

2. A structural improvement of submersible cooling pumps as defined in claim 1, wherein there are provided on the motor casing of said motor set two or more positioning holes that extend through a thickness of a bottom of the motor casing to allow fixing bolts inserted through the top plate to pass through and be fastened to the fixing hole of the fixing base.

3. A structural improvement of submersible cooling pumps as defined in claim 1 or 2, wherein there is provided additionally a filter drum between the impeller set and the motor set; the fixing base of said motor set has an upper annular groove to allow a top end of the filter drum to fit in; wherein there are provided on an upper surface of said impeller set a plurality of inlet passages for water, and a lower annular groove is formed around a peripheral of said inlet passages for water to allow a bottom end of the filter drum to fit in; wherein said filter drum is a one piece component, wherein all surfaces have filter holes provided thereon.

4. A structural improvement of submersible cooling pumps as defined in claim 3, wherein there is provided on an upper surface of the top cover of said impeller set a lower annular groove to allow the bottom end of the filter drum to fit in.

* * * * *